US011189216B2

(12) United States Patent
Sun et al.

(10) Patent No.: US 11,189,216 B2
(45) **Date of Patent: *Nov. 30, 2021**

(54) RAPID DISCHARGING CIRCUIT, DISPLAY DEVICE, RAPID DISCHARGING METHOD AND DISPLAY CONTROL METHOD

(71) Applicants: ORDOS YUANSHENG OPTOELECTRONICS CO., LTD., Inner Mongolia (CN); BOE TECHNOLOGY GROUP CO., LTD., Beijing (CN)

(72) Inventors: Shicheng Sun, Beijing (CN); Zhen Wang, Beijing (CN); Lele Cong, Beijing (CN); Yezhou Fang, Beijing (CN); Peirong Huo, Beijing (CN)

(73) Assignees: ORDOS YUANSHENG OPTOELECTRONICS CO., LTD., Inner Mongolia (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/844,430

(22) Filed: Apr. 9, 2020

(65) Prior Publication Data

US 2020/0234627 A1 Jul. 23, 2020

Related U.S. Application Data

(63) Continuation of application No. 15/774,182, filed as application No. PCT/CN2017/104161 on Sep. 29, 2017, now Pat. No. 10,650,719.

(30) Foreign Application Priority Data

Mar. 23, 2017 (CN) ..... 201710177793.8

(51) Int. Cl.
*G09G 3/20* (2006.01)

(52) U.S. Cl.
CPC ..... *G09G 3/2085* (2013.01); *G09G 3/20* (2013.01); *G09G 3/2092* (2013.01);
(Continued)

(58) Field of Classification Search
CPC .. G09G 3/2085; G09G 3/2092; G09G 3/3266; G09G 2330/027; G09G 3/20;
(Continued)

(56) References Cited

U.S. PATENT DOCUMENTS

2008/0049000 A1 2/2008 Kim et al.
2008/0143702 A1 6/2008 Park
(Continued)

FOREIGN PATENT DOCUMENTS

CN 101101385 A 1/2008
CN 101174038 A 5/2008
(Continued)

OTHER PUBLICATIONS

First Office Action for Chinese Application No. 201710177793.8, dated Apr. 3, 2018, 5 Pages.
(Continued)

*Primary Examiner* — Xuemei Zheng
(74) *Attorney, Agent, or Firm* — Brooks Kushman P.C.

(57) ABSTRACT

A rapid discharging circuit, a display device, a rapid discharging method and a display control circuit are provided. The rapid discharging circuit includes a discharging unit. A control end of the discharging unit is connected to a driving IC, a first end thereof is connected to a gate line of the display device, and a second end thereof is connected to a display level end of the display device which is connected to the driving IC. The discharging unit is configured to control
(Continued)

the display level end to write a first level into the gate line when the display device is powered off abnormally.

9 Claims, 7 Drawing Sheets

(52) U.S. Cl.
CPC ..... *G09G 2300/0426* (2013.01); *G09G 2310/0248* (2013.01); *G09G 2310/0251* (2013.01); *G09G 2310/08* (2013.01); *G09G 2330/021* (2013.01); *G09G 2330/027* (2013.01)

(58) Field of Classification Search
CPC ... G09G 2300/0426; G09G 2310/0248; G09G 2310/0251; G09G 2310/08; G09G 2330/021
See application file for complete search history.

(56) References Cited

U.S. PATENT DOCUMENTS

2008/0165109 A1 7/2008 Joo et al.
2009/0085902 A1 4/2009 Yamamoto et al.
2015/0049071 A1 2/2015 Kaneko
2015/0206477 A1* 7/2015 Xu ..... G09G 3/3233 345/206
2015/0348507 A1 12/2015 Zhang et al.
2015/0355683 A1* 12/2015 Imana ..... G06F 1/1626 345/173
2017/0069270 A1 3/2017 Hyeon et al.

FOREIGN PATENT DOCUMENTS

CN 103034006 A 4/2013
CN 104221075 A 12/2014
CN 104616615 A 5/2015
CN 106652884 A 5/2017

OTHER PUBLICATIONS

International Search Report and Written Opinion for Application No. PCT/CN2017/104161, dated Jan. 4, 2018, 14 Pages.
U.S. Non-Final Office Action dated Aug. 19, 2019, U.S. Appl. No. 15/774,182, 18 Pages.

* cited by examiner

RAPID DISCHARGING CIRCUIT, DISPLAY DEVICE, RAPID DISCHARGING METHOD AND DISPLAY CONTROL METHOD

CROSS-REFERENCE TO RELATED APPLICATIONS

This application is a continuation of U.S. application Ser. No. 15/774,182, filed May 7, 2018, which is the U.S. national phase of PCT Application No. PCT/CN2017/104161 filed on Sep. 29, 2017, which claims priority to Chinese Patent Application No. 201710177793.8 filed on Mar. 23, 2017, which are incorporated herein by reference in their entireties.

TECHNICAL FIELD

The present disclosure relates to the field of discharging control technology, in particular to a rapid discharging circuit, a display device, a rapid discharging method and a display control method.

BACKGROUND

Due to its manufacture process and a double-gate-based structure, a Low Temperature Poly-Silicon (LTPS) display product has a relatively small leakage current Ioff. When a display panel is powered off abnormally, charges of the LTPS display product are released slowly due to the small leakage current Ioff, and thereby residual charges may easily occur. Hence, after a display device is powered off abnormally, it is necessary to provide a discharging unit, so as to rapidly release the charges at a pixel region of the display panel. For a conventional rapid discharging circuit of the display device, it is necessary to provide an additional space for the discharging unit in a Gate On Array (GOA) circuit. In addition, during the manufacture of the display panel, a large number of masks need to be adopted, resulting in high manufacture cost.

SUMMARY

A main object of the present disclosure is to provide a rapid discharging circuit, a display device, a rapid discharging method and a display control method, so as to solve the problem in the related art where the manufacture cost is high due to the specific space for the discharging unit and the large number of masks during the manufacture of the display panel.

In one aspect, the present disclosure, the present disclosure provides in some embodiments a rapid discharging circuit for use in a display device, including a discharging unit. A control end of the discharging unit is connected to a driving integrated circuit (IC), a first end thereof is connected to a gate line of the display device, and a second end thereof is connected to a display level end of the display device which is connected to the driving IC. The discharging unit is configured to control the display level end to write a first level into the gate line when the display device is powered off abnormally.

In a possible embodiment of the present disclosure, the discharging unit includes a discharging transistor, a gate electrode of which is connected to the driving IC, a first electrode of which is connected to the gate line, and a second electrode of which is connected to the display level end.

In another aspect, the present disclosure provides in some embodiments a display device, including a plurality of gate lines, a plurality of data lines, a data switch and a driving IC. The driving IC includes a data voltage supplying unit. A first end of the data switch is connected to the data voltage supplying unit, and a second end of the data switch is connected to the data lines. The display device further includes the above-mentioned rapid discharging circuit. The driving IC further includes a determination unit, a potential control unit and a data line control unit. A control end of the data switch is connected to the data line control unit. The determination unit is configured to determine whether or not the display device is powered off abnormally, and when the display device is powered off abnormally, output an abnormal power-off indication signal. The potential control unit is connected to the determination unit, a control end of a discharging unit of the rapid discharging circuit and a display level end, and configured to, upon the receipt of the abnormal power-off indication signal, output a discharging control signal to the control end of the discharging unit, and control a potential at the display level end to be a first level. The data line control unit is connected to the determination unit, the control end of the data switch and the data voltage supplying unit, and configured to, upon the receipt of the abnormal power-off indication signal from the determination unit, control the data switch so that the data voltage supplying unit writes a predetermined discharging level into the data line. The discharging unit is configured to, upon the receipt of the discharging control signal at the control end, control the display level end to write the first level into the gate line.

In a possible embodiment of the present disclosure, when a thin film transistor (TFT) at a pixel region whose gate electrode is connected to the gate line is an n-type transistor, the first level is a high level, and when the TFT at the pixel region whose gate electrode is connected to the gate line is a p-type transistor, the first level is a low level.

In a possible embodiment of the present disclosure, the discharging unit includes a discharging transistor, a gate electrode of which is connected to the potential control unit, a first electrode of which is connected to the gate line, and the second electrode of which is connected to the display level end. The potential control unit is further configured to, when the abnormal power-off indication signal fails to be received, turn on the discharging transistor at a touch time period, and control the display level end to write a second level into the gate line.

In a possible embodiment of the present disclosure, when a TFT at a pixel region whose gate electrode is connected to the gate line is an n-type transistor, the second level is a low level, and when the TFT at the pixel region whose gate electrode is connected to the gate line is a p-type transistor, the second level is a high level.

In a possible embodiment of the present disclosure, the display level end is a display low-level end not connected to an electrostatic protection low-level end of the display device used in an electrostatic protection circuit.

In a possible embodiment of the present disclosure, the display device further includes a gate driving circuit connected to a start signal input end, a clock signal input end, a first scanning voltage output end and a second scanning voltage output end. The discharging unit is further connected to the start signal input end, the clock signal input end, the first scanning voltage output end and the second scanning voltage output end, and further configured to, upon the receipt of the abnormal power-off indication signal, apply a third level to the start signal input end, the clock signal input end, the first scanning voltage output end and the second scanning voltage output end, so as to control the gate driving circuit to operate normally.

In a possible embodiment of the present disclosure, the data voltage supplying unit is a data driving circuit in the driving IC, the determination unit is a comparator in the driving IC, the potential control unit is a register in the driving IC, and the data line control unit is a controller in the driving IC.

In a possible embodiment of the present disclosure, the predetermined discharging level is a ground level.

In yet another aspect, the present disclosure provides in some embodiments a rapid discharging method for use in the above-mentioned rapid discharging circuit, including a step of, when a display device is powered off abnormally, controlling, by a discharging unit, a display level end to write a first level into a gate line.

In still yet another aspect, the present disclosure provides in some embodiments a display control method for use in the above-mentioned display device, including steps of: when a determination unit has determined that a display device is powered off abnormally, outputting, by the determination unit, an abnormal power-off indication signal to a potential control unit and a data line control unit; when the abnormal power-off indication signal has been received by the data line control unit, controlling, by the data line control unit, a data switch so that a data voltage supplying unit writes a predetermined discharging level into a data line, and when the abnormal power-off indication signal has been received by the potential control unit, outputting, by the potential control unit, a discharging control signal to a control end of a discharging unit, and controlling a potential at a display level end to be a first level; when the discharging control signal has been received by the control end of the discharging unit, controlling, by the discharging unit, the display level end to write the first level into a gate line, so as to turn on a TFT at a pixel region whose gate electrode is connected to the gate line; and releasing residual charges on a pixel electrode to the data line through the TFT which has been turned on.

In a possible embodiment of the present disclosure, the discharging unit includes a discharging transistor, a gate electrode of which is connected to the potential control unit, a first electrode of which is connected to the corresponding gate line, and a second electrode of which is connected to the display level end. The display control method further includes, when the abnormal power-off indication signal fails to be received by the potential control unit, controlling, by the potential control unit, the discharging transistor to be turned on and controlling the display level end to write a second level into the gate line at a touch time period.

In a possible embodiment of the present disclosure, the display level end of the display device is a display low-level end, and the display control method further includes enabling the display low-level end to be separated from an electrostatic protection low-level end of the display device, so that the display low-level end is not connected to the electrostatic protection low-level end.

In a possible embodiment of the present disclosure, the predetermined discharging level is a ground level.

BRIEF DESCRIPTION OF THE DRAWINGS

In order to illustrate the technical solutions of the present disclosure or the related art in a clearer manner, the drawings desired for the present disclosure will be described hereinafter briefly. Obviously, the following drawings merely relate to some embodiments of the present disclosure, and based on these drawings, a person skilled in the art may obtain the other drawings without any creative effort. Shapes and sizes of the members in the drawings are for illustrative purposes only, but shall not be used to reflect any actual scale.

DETAILED DESCRIPTION

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

Unless otherwise defined, any technical or scientific term used herein shall have the common meaning understood by a person of ordinary skills. Such words as "first" and "second" used in the specification and claims are merely used to differentiate different components rather than to represent any order, number or importance. Similarly, such words as "one" or "one of" are merely used to represent the existence of at least one member, rather than to limit the number thereof. Such words as "connect" or "connected to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

Figure 1:
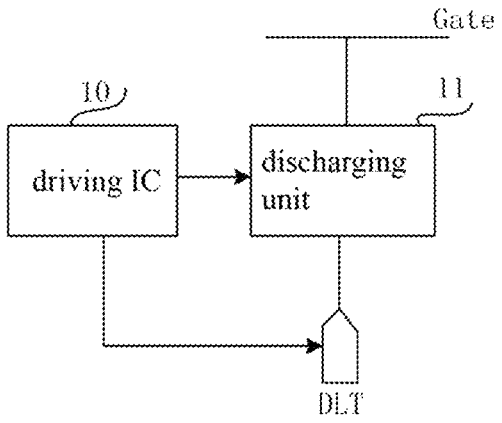
FIG. 1 is a schematic view showing a rapid discharging circuit according to one embodiment of the present disclosure.

The present disclosure provides in some embodiments a rapid discharging circuit for use in a display device. As shown in FIG. 1, the rapid discharging circuit includes a discharging unit 11. A control end of the discharging unit 11 is connected to a driving IC 10, a first end thereof is connected to a gate line Gate of the display device, and a second end thereof is connected to a display level end DLT of the display device which is connected to the driving IC 10. The discharging unit 11 is configured to control the display level end DLT to write a first level into the gate line Gate when the display device is powered off abnormally.

During the implementation, when a power source voltage from a power source circuit of the display device and/or an external power source voltage received by the power source circuit are not within a predetermined range, a determination unit of the display device may determine that the display device is powered off abnormally.

In actual use, the driving IC 10 is a driving chip integrated with a data driving circuit, a timing controller and the power source circuit.

During the implementation, the discharging unit 11 of the rapid discharging circuit is just a known circuit unit of the display device. Different from the related art, in the embodiments of the present disclosure, when the display device is powered off abnormally, the driving IC 10 may apply the first level to the display level end DLT, and the discharging unit 11 may control the display level end DLT to write the first level into the gate line Gate, so as to turn on a TFT at a pixel region whose gate electrode is connected to the gate line Gate.

Figure 2:
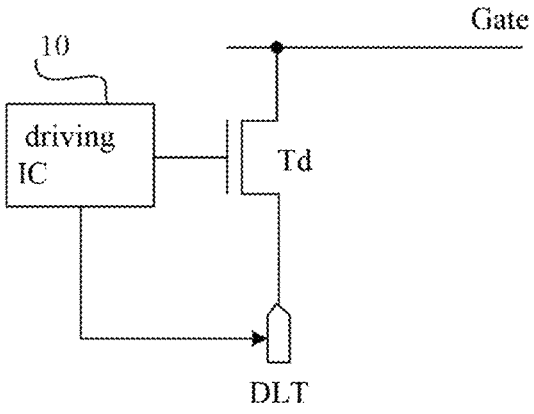
FIG. 2 is a schematic view showing a discharging unit of the rapid discharging circuit according to one embodiment of the present disclosure.

In actual use, as shown in FIG. 2, the discharging unit 11 includes a discharging transistor Td, a gate electrode of which is connected to the driving IC 10, a source electrode of which is connected to the gate line Gate, and a drain electrode of which is connected to the display level end DLT.

In the embodiments as shown in FIG. 2, Td is an n-type transistor. However, in actual use, Td may also be a p-type transistor.

Figure 3:
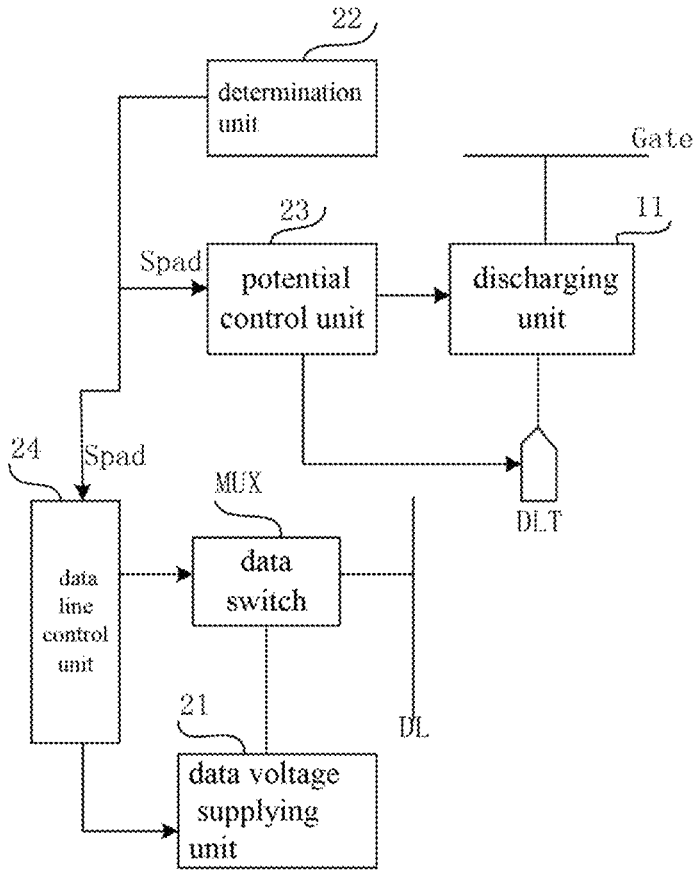
FIG. 3 is a schematic view showing a display device according to one embodiment of the present disclosure.

The present disclosure further provides in some embodiments a display device which, as shown in FIG. 3, includes a plurality of gate lines, a plurality of data lines, a data switch MUX and a driving IC.

The driving IC includes a data voltage supplying unit 21. A first end of the data switch MUX is connected to the data voltage supplying unit 21, and a second end of the data switch MUX is connected to the data lines DL. The driving IC further includes a determination unit 22, a potential control unit 23 and a data line control unit 24. A control end of the data switch MUX is connected to the data line control unit 24. The display device further includes the above-mentioned rapid discharging circuit. The rapid discharging circuit includes a discharging unit 11, a control end of which is connected to the potential control unit 23, a first end of which is connected to a gate line Gate of the display device, and a second end of which is connected to a display level end DLT of the display device. The display level end DLT is further connected to the potential control unit 23. The determination unit 22 is configured to determine whether or not the display device is powered off abnormally, and when the display device is powered off abnormally, output an abnormal power-off indication signal Spad. The potential control unit 23 is connected to the determination unit 22, the control end of the discharging unit 11 and the display level end DLT, and configured to, upon the receipt of the abnormal power-off indication signal Spad, output a discharging control signal to the control end of the discharging unit 11, and control a potential at the display level end DLT to be a first level. The data line control unit 24 is connected to the determination unit 22, the control end of the data switch MUX and the data voltage supplying unit 21, and configured to, upon the receipt of the abnormal power-off indication signal Spad from the determination unit 22, control the data switch MUX in such a manner as to enable the data voltage supplying unit 21 to write a predetermined discharging level into the data line DL. The discharging unit 11 is configured to, upon the receipt of the discharging control signal at the control end, control the display level end DLT to write the first level into the gate line Gate.

In actual use, the data voltage supplying unit may be a data driving circuit in the driving IC, the determination unit may be a comparator in the driving IC which is capable of comparing power source voltages received by a power source circuit so as to determine whether or not the display device is powered off abnormally, the potential control unit may be a register in the driving IC, and the data line control unit may be a controller in the driving IC.

A plurality of pixel regions is defined by the gate lines and the data lines, and a TFT and a pixel electrode is arranged at each pixel region. A gate electrode of the TFT is connected to the corresponding gate line, a source electrode thereof is connected to the corresponding data line, and a drain electrode thereof is connected to the pixel electrode.

FIG. 3 fails to show the gate lines, the data lines, and the TFT and the pixel electrode at each pixel region, which will be described hereinafter in conjunction with FIG. 4.

The rapid discharging circuit of the display device includes a plurality of discharging units. Each discharging unit is connected to the corresponding gate line and configured to apply the first level to the corresponding gate line when the display device is powered off abnormally, so as to turn on the corresponding TFT at the pixel region whose gate electrode is connected to the gate line. At this time, the data line control unit controls the data switch in such a manner as to enable the data voltage supplying unit to write the predetermined discharging level into the corresponding data line, so as to release residual charges in the pixel electrode to the data line through the TFT which has been turned on.

In a possible embodiment of the present disclosure, the predetermined discharging level is a ground level.

During the implementation, when the data lines are grounded (i.e., the group level is applied thereto), it is able to acquire an optimum discharging effect.

According to the display device in the embodiments of the present disclosure, through the discharging unit and the display level end, it is able to, when the display device is powered off abnormally, release the residual charges at the pixel region to the corresponding data line. As compared with the related art, it is able to save the space for the members for releasing the charges, change the original display product as small as possible, and reduce the number of the masks, thereby to reduce the manufacture cost.

Figure 4:
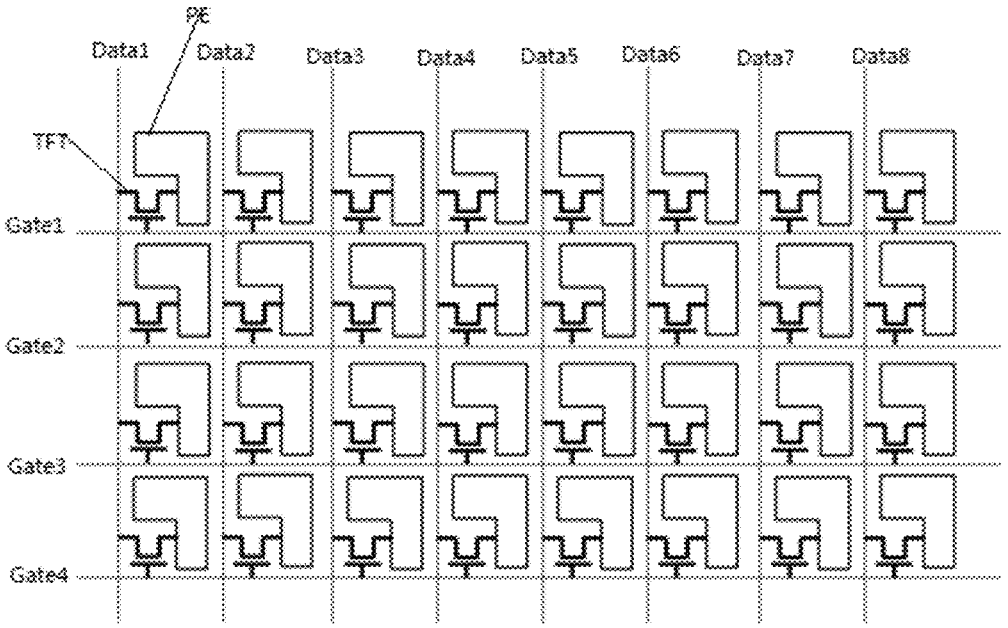
FIG. 4 is a schematic view showing a pixel region of the display device according to one embodiment of the present disclosure.

As shown in FIG. 4, the display device includes the plurality of gate lines and the plurality of data lines arranged at an active area (AA). The pixel regions are defined by the gate lines and the data lines, and the TFT and the pixel electrode are arranged at each pixel region. The gate electrode of the TFT is connected to the corresponding gate line, the source electrode thereof is connected to the corresponding data line, and the drain electrode thereof is connected to the pixel electrode.

In FIG. 4, Gate1, Gate2, Gate3 and Gate4 represent a first gate line, a second gate line, a third gate line and a fourth gate line respectively. Data1, Data2, Data3, Data4, Data5, Data6, Data7 and Data8 represent a first data line, a second data line, a third data line, a fourth data line, a fifth data line, a sixth data line, a seventh data line and an eighth data line respectively. TFT represents the thin film transistor, and PE represents the pixel electrode.

In actual use, the data lines are connected to a data driving circuit arranged in the driving IC.

When the TFT at the pixel region whose gate electrode is connected to the corresponding gate line is an n-type transistor, the first level is a high level, and when the TFT at the pixel region whose gate electrode is connected to the corresponding gate line is a p-type transistor, the first level is a low level.

To be specific, the discharging unit may include a discharging transistor, a gate electrode of which is connected to the potential control unit, a first electrode of which is connected to the corresponding gate line, and a second electrode of which is connected to the display level end.

Figure 5A:
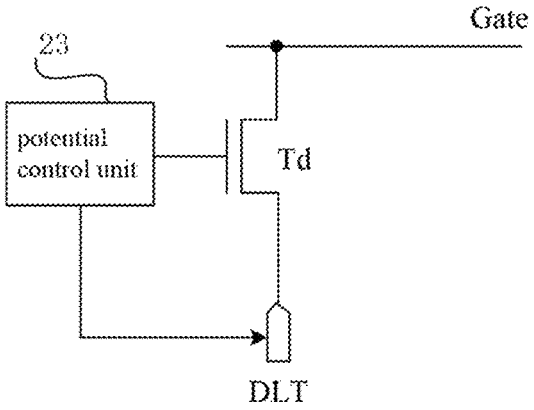
FIG. 5A is a schematic view showing a discharging unit of a rapid discharging circuit of the display device according to one embodiment of the present disclosure.

To be specific, as shown in FIG. 5A, when the discharging unit 11 includes the discharging transistor Td, the gate electrode of the discharging transistor Td is connected to the potential control unit 23, a source electrode thereof is connected to the corresponding gate line Gate, and a drain electrode thereof is connected to the display level end DLT.

The potential control unit 23 is further configured to, when the abnormal power-off indication signal fails to be received, control the discharging transistor Td to be turned on at a touch time period, and control the display level end DLT to write a second level into the gate line Gate, so as to turn off the TFT at the pixel region whose gate electrode is connected to the gate line. In other words, a touch control transistor in the related art may be multiplexed as the discharging transistor Td for controlling a level applied to the gate line at the touch time period, so as to turn off the TFT at the pixel region whose gate electrode is connected to the gate line. In actual use, any other transistor of the display device may be multiplexed as the discharging transistor, which will not be particularly defined herein.

When the TFT at the pixel region whose gate electrode is connected to the corresponding gate line is the n-type transistor, the second level is a low level, and when the TFT at the pixel region whose gate electrode is connected to the corresponding gate line is the p-type transistor, the second level is a high level.

Figure 5B:
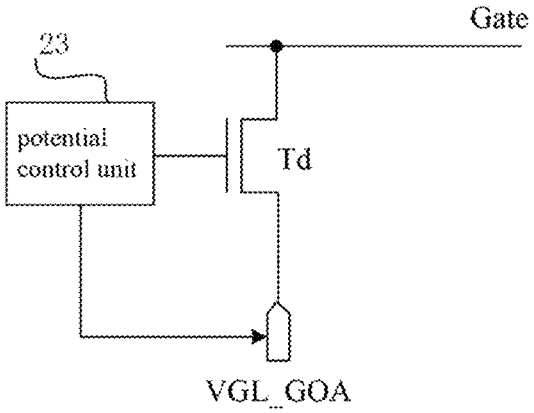
FIG. 5B is another schematic view showing the discharging unit according to one embodiment of the present disclosure.

During the implementation, as shown in FIG. 5B, the display level end may be a display low-level end VGL_GOA. The potential control unit 23 is further configured to, upon the receipt of the abnormal power-off indication signal, control the display low-level end VGL_GOA to output the first level.

In actual use, VGL_GOA may output a low level which cannot be pulled up. Hence, in the embodiments of the present disclosure, a high level may be applied to VGL_GOA through an output end of the driving IC, so as pull up the potential at CGL_GOA to be the high level when the display device is powered off abnormally.

Figure 5C:
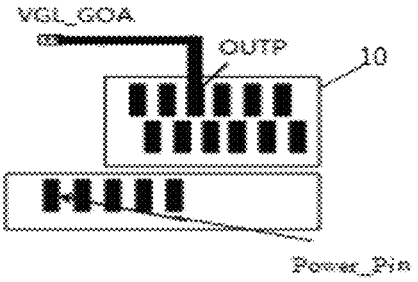
FIG. 5C is a schematic view showing a connection relationship between a display low-level end VGL_GOA and an output end of a driving IC according to one embodiment of the present disclosure.

As shown in FIG. 5C, VGL_GOA is connected to the output end OUTP of the driving IC 10, different from the related art where VGL_GOA is connected to a power source end Power_Pin.

Figure 6:
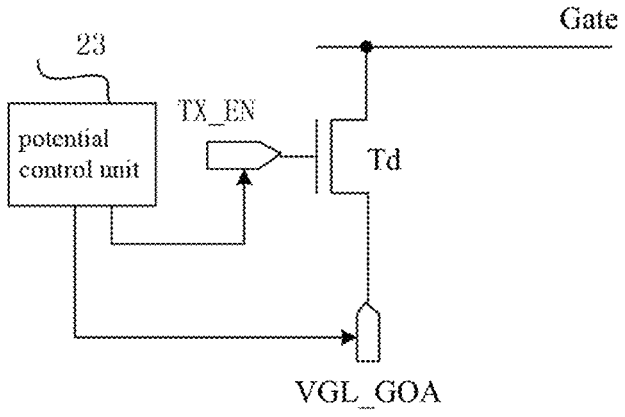
FIG. 6 is yet another schematic view showing the discharging unit according to one embodiment of the present disclosure.

As shown in FIG. 6, the gate electrode of the discharging transistor Td is connected to a touch enabling end TX_EN which is connected to the potential control unit 23, the first electrode thereof is connected to the corresponding gate line Gate, and the second electrode thereof is connected to the display low-level end VGL_GOA. In other words, the touch control transistor is multiplexed as the discharging transistor Td. The discharging transistor Td is an n-type transistor (however, in actual use, Td may also be a p-type transistor, which will not be particularly defined herein).

When the display device is powered off abnormally, the potential control unit may control a potential at TX_EN to be a high level and control a potential at VGL_GOA to be a high level too, so as to turn on Td and apply a high level to the corresponding gate line Gate, thereby to turn on each TFT at the pixel region whose gate electrode is connected to the gate line Gate. In this way, it is able to rapidly release the residual charges in the pixel electrode connected to the drain electrode of the TFT to the corresponding data line connected to the source electrode of the TFT.

In actual use, when the display level end is the display low-level end VGL_GOA, the display low-level end VGL_GOA is not connected to an electrostatic low-level end of an electrostatic protection circuit of the display device.

In actual use, when the touch control transistor is multiplexed as the discharging transistor, the discharging transistor Td and a GOA circuit are both connected to the display low-level end VGL_GOA. Due to the structure of the electrostatic protection circuit, if, like in the related art, VGL_GOA is connected to the electrostatic protection circuit, it is impossible to pull up a potential at the electrostatic protection low-level end VGL_ESD at a discharging stage, and thereby it is impossible to pull up the potential at the display low-level end VGL_GOA at the discharging stage. Hence, different from the related art, in the embodiments of the present disclosure, the display low-level end needs to be separated from the electrostatic protection low-level end.

During the implementation, the display device further includes a gate driving circuit connected to a start signal input end, a clock signal input end, a first scanning voltage output end and a second scanning voltage output end. The discharging unit is further connected to the start signal input end, the clock signal input end, the first scanning voltage output end and the second scanning voltage output end, and further configured to, upon the receipt of the abnormal power-off indication signal, apply a third level to the start signal input end, the clock signal input end, the first scanning voltage output end and the second scanning voltage output end, so as to control the gate driving circuit to operate normally.

When the TFT at the pixel region is an n-type transistor, the third level is a high level.

In actual use, it is necessary to ensure the normal operation of the gate driving circuit at the discharging stage, so as to enable TX_EN to control the discharging transistor to release the charges.

During the implementation, the first electrode of the discharging transistor of the discharging unit is connected to an output end of the gate driving circuit, so when the display device is powered off abnormally, it is necessary to set a potential of a signal for the gate driving circuit, e.g., a clock signal, as a high level, so as to set a potential of a gate driving signal at the active area as a high level. In this way, it is able to prevent the occurrence of such a situation where the voltage applied to the gate line at the pixel region cannot be pulled up due to the low-level gate driving signal from the gate driving circuit when the display device is powered off abnormally, thereby to rapidly release the charges.

The present disclosure further provides in some embodiments a rapid discharging method for use in the above-mentioned rapid discharging circuit. The rapid discharging method includes a step of, when a display device is powered off abnormally, controlling, by a discharging unit, a display level end to write a first level into a gate line.

Figure 7:
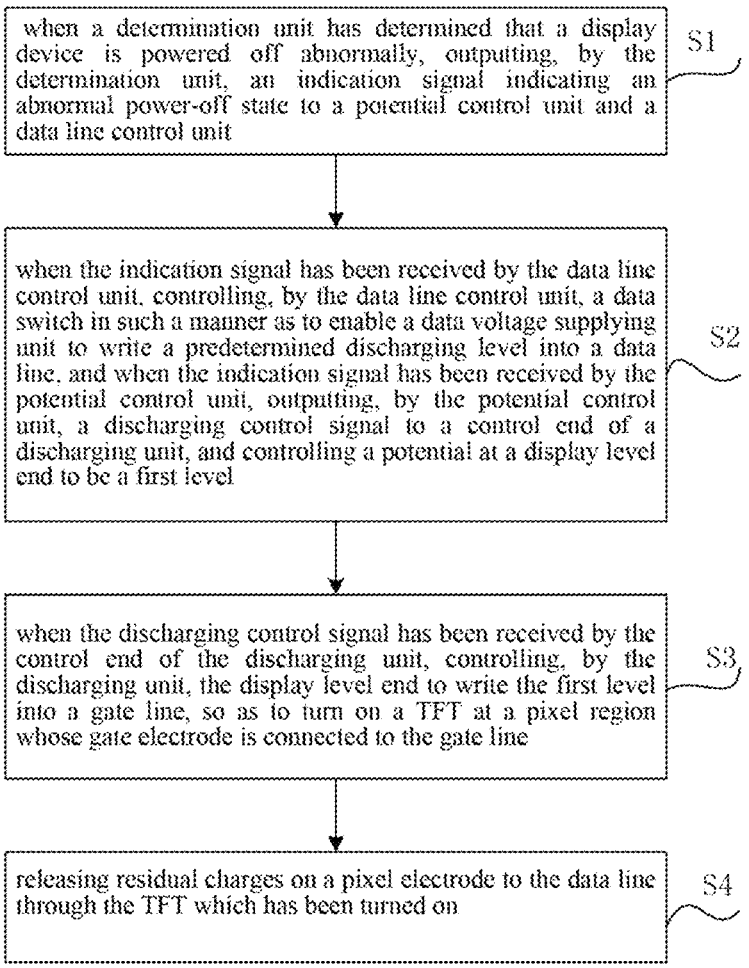
FIG. 7 is a flow chart of a display control method according to one embodiment of the present disclosure.

The present disclosure further provides in some embodiments a display control method for use in the above-mentioned display device. As shown in FIG. 7, the display control method includes: S1 of, when a determination unit has determined that a display device is powered off abnormally, outputting, by the determination unit, an abnormal power-off indication signal to a potential control unit and a data line control unit; S2 of, when the abnormal power-off indication signal has been received by the data line control unit, controlling, by the data line control unit, a data switch in such a manner as to enable a data voltage supplying unit to write a predetermined discharging level into a data line, and when the abnormal power-off indication signal has been received by the potential control unit, outputting, by the potential control unit, a discharging control signal to a control end of a discharging unit, and controlling a potential at a display level end to be a first level; S3 of, when the discharging control signal has been received by the control end of the discharging unit, controlling, by the discharging unit, the display level end to write the first level into a gate line, so as to turn on a TFT at a pixel region whose gate electrode is connected to the gate line; and S4 of releasing residual charges on a pixel electrode to the data line through the TFT which has been turned on.

To be specific, the discharging unit includes a discharging transistor, a gate electrode of which is connected to the potential control unit, a first electrode of which is connected to the corresponding gate line, and a second electrode of which is connected to the display level end. The display control method further includes, when the abnormal power-off indication signal fails to be received by the potential control unit, controlling, by the potential control unit, the discharging transistor to be turned on and controlling the display level end to write a second level into the gate line at a touch time period.

To be specific, the display level end of the display device is a display low-level end, and the display control method further includes enabling the display low-level end to be separated from an electrostatic protection low-level end of the display device, so that the display low-level end is not connected to the electrostatic protection low-level end.

For the display device in the embodiments of the present disclosure, the display low-level end VGL_GOA is separated from the electrostatic protection low-level end VGL_ESD. Due to the structure of the electrostatic protection circuit, it is impossible to pull up a potential at the electrostatic protection low-level end VGL_ESD at a discharging stage, and thereby it is impossible to pull up the potential at the display low-level end VGL_GOA at the discharging stage. Hence, different from the related art, in the embodiments of the present disclosure, the display low-level end needs to be separated from the electrostatic protection low-level end.

Figure 8:
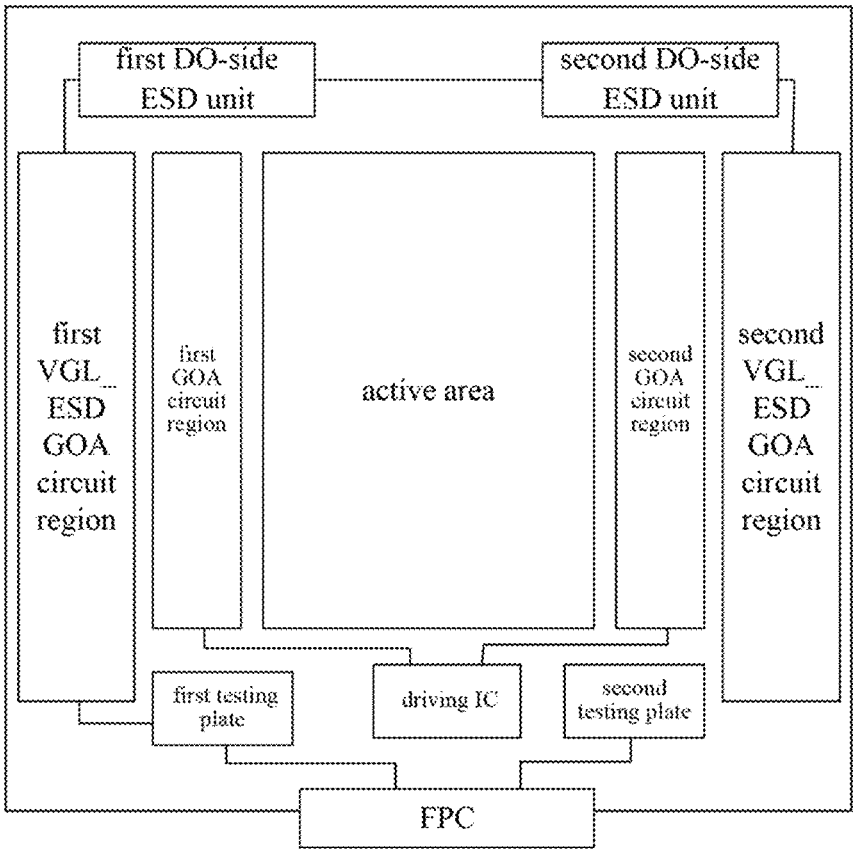
FIG. 8 is schematic view showing a situation where VGL_GOA is separated from VGL_ESD according to one embodiment of the present disclosure.

FIG. 8 is a schematic view showing a situation where VGL_GOA is separated from VGL_EST. FIG. 8 intends to show wiring regions for the display device. As shown in FIG. 8, on a display substrate, a first GOA circuit region and a second GOA circuit region are arranged at a left side and a right side of the active area AA respectively, and the display low-level end VGL_GOA is arranged at the first GOA circuit region and the second GOA circuit region. A first VGL_ESD GOA circuit region is arranged at a left side of the first GOA circuit region, and a second VGL_ESD GOA circuit region is arranged at a right side of the second GOA circuit region. The electrostatic protection low-level end VGL_ESD used for protecting ESD units of the GOA circuit and connected to DO-side ESD units is arranged at the first VGL_ESD GOA circuit region and the second VGL-ESD GOA circuit region. A first DO-side (a side opposite to the driving IC) ESD unit is arranged at an upper left side of the active area AA, and a second DO-side ESD unit is arranged at an upper right side of the active area AA. A first testing plate is arranged at a lower left side of the active area AA, and a second testing plate is arranged at a lower right side of the active area AA. Each of the first testing plate and the second testing plate are provided with testing points for testing signals inputted to the driving IC (including clock signal, high-level signal VGH and low-level signal VGL), and a testing operation may be performed using a probe of an oscilloscope. The driving IC and a flexible printed circuit (FPC) are arranged sequentially right below the active area AA.

In the related art, the first DO-side ESD unit, the second DO-side ESD unit, the first VGL_ESD GOA circuit region, the second VGL_ESD GOA circuit region, the first testing plate, the second testing plate, the first GOA circuit region and the second GIA circuit region may each acquire a low level through a VGL bus (i.e., a line for providing a low level). However, in the embodiments of the present disclosure, the first GOA circuit region and the second GOA circuit region each need to acquire a high level from the output end of the driving IC through VGL_GOA, so it is necessary to separate VGL_GOA from VGL_ESD.

Figure 9:
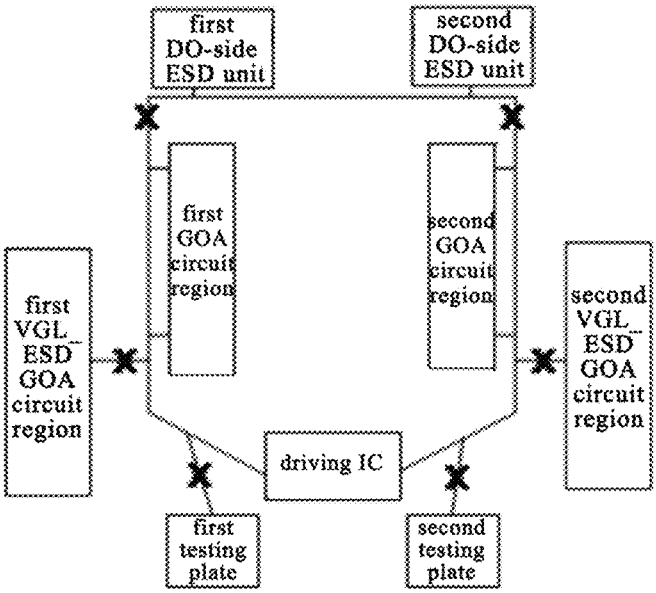
FIG. 9 is a schematic view showing a situation where signal lines between units in FIG. 8 are connected or not connected.

In FIG. 9, the connection lines between the units are signal lines, and each X mark represents an interruption position. In the embodiments of the present disclosure, a signal line between the first GOA circuit region and the driving IC and a signal line between the second GOA circuit region and the driving IC are newly added.

Figure 10A:
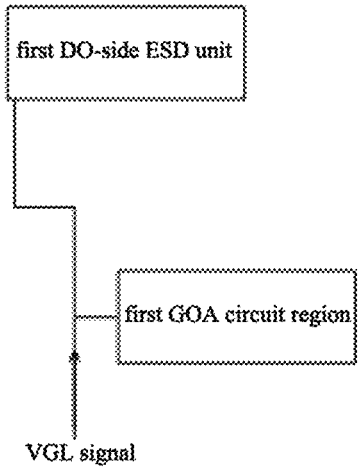
FIG. 10A is a schematic view showing a situation where a first Data Output (DO)-side ElectroStatic Discharging (ESD) unit and a first GOA circuit region share a same VGL signal in the related art.
Figure 10B:
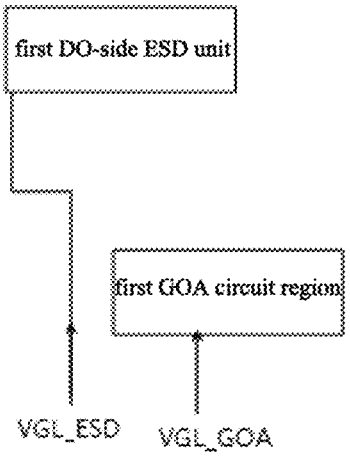
FIG. 10B is a schematic view showing a situation where the first DO-side ESD units acquires a low level VGL through an electrostatic protection low-level end VGL_ESD and the first GOA circuit region is connected to the display low-level end VGL_GOA according to one embodiment of the present disclosure.

As shown in FIG. 10A, in the related art, the first DO-side ESD unit and the first GOA circuit region share a same VGL signal from a power source end (not shown). As shown in FIG. 10B, in the embodiments of the present disclosure, the first DO-side ESD unit acquires a low level VGL from the power source end (not shown) through the electrostatic protection low level end VGL_ESD, and the first GOA circuit region acquires a high level from the output end of the driving IC (not shown) through the display low-level end VGL_GOA when the display device is powered off abnormally.

Figure 11A:
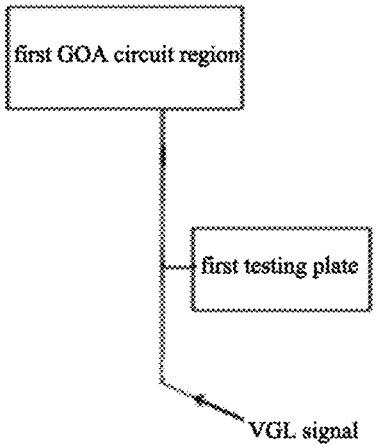
FIG. 11A is a schematic view showing a situation where the first GOA circuit region and a first testing plate share a same VGL signal in the related art.
Figure 11B:
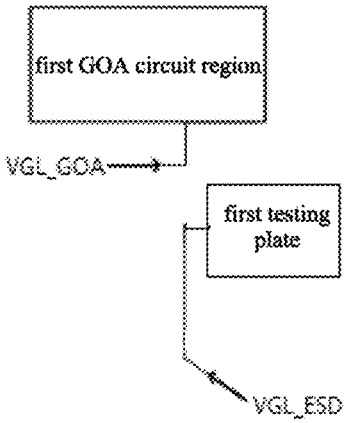
FIG. 11B is a schematic view showing a situation where the first testing plate acquires the low level VGL through the electrostatic protection low-level end VGL_ESD and the first GOA circuit region is connected to the display low-level end VGL_GOA according to one embodiment of the present disclosure.

As shown in FIG. 11A, in the related art, the first GOA circuit region and the first testing plate each acquire the VGL signal from the power source end (not shown). However, in the embodiments of the present disclosure, as shown in FIG. 11B, the first GOA circuit region acquires a high level from the output end of the driving IC (not shown) through the display low-level end VGL_GOA when the display device is powered off abnormally, and the first testing plate still acquires the VGL signal from the power source end (not shown) through the electrostatic protection low level end VGL_ESD.

The above are merely the preferred embodiments of the present disclosure, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A display device, comprising a plurality of gate lines, a plurality of data lines, a data switch and a driving Integrated Circuit (IC), wherein the driving IC comprises a data voltage supplying unit;

a first end of the data switch is connected to the data voltage supplying unit, and a second end of the data switch is connected to the data lines;

the display device further comprises a rapid discharging circuit comprising a discharging unit, wherein a control end of the discharging unit is connected to a driving integrated circuit (IC), a first end of the discharging unit is connected to a gate line of the display device, and a second end of the discharging unit is connected to a display level end of the display device, the display level end is connected to the driving IC;

the driving IC further comprises a determination unit, a potential control unit and a data line control unit;

a control end of the data switch is connected to the data line control unit;

the potential control unit is connected to the determination unit, a control end of the discharging unit and the display level end;

the data line control unit is connected to the determination unit, the control end of the data switch and the data voltage supplying unit; and the discharging unit comprises a discharging transistor, a gate electrode of the discharging transistor is connected to the potential control unit, a first electrode of the discharging transistor is connected to the gate line, and a second electrode of the discharging transistor is connected to the display level end, wherein the data voltage supplying unit is a data driving circuit in the driving IC, the determination unit is a comparator in the driving IC, the potential control unit is a register in the driving IC, and the data line control unit is a controller in the driving IC.

2. The display device according to claim 1, wherein a thin film transistor (TFT) at a pixel region whose gate electrode is connected to the gate line is an n-type transistor.

3. The display device according to claim 1, wherein a TFT at a pixel region whose gate electrode is connected to the gate line is a p-type transistor.

4. The display device according to claim 1, wherein the display level end is a display low-level end, the display low-level end is not connected to an electrostatic protection low-level end of the display device used in an electrostatic protection circuit.

5. The display device according to claim 1, wherein a predetermined discharging level is a ground level.

6. The display control method according to claim 1, wherein the potential control unit is further configured to turn on the discharging transistor at a touch time period.

7. A display control method for use in the display device according to claim 1, comprising steps of:

determining, by the determination unit, that the display device is powered off abnormally, and outputting an abnormal power-off indication signal to the potential control unit and the data line control unit;

receiving, by the data line control unit, the abnormal power-off indication signal, and controlling a data switch so that the data voltage supplying unit writes a predetermined discharging level into a data line, receiving, by the potential control unit, the abnormal power-off indication signal, and outputting a discharging control signal to a control end of the discharging unit, and controlling a potential at the display level end to be a first level;

receiving, by the discharging unit, the discharging control signal at the control end of the discharging unit, and controlling the display level end to write the first level into the gate line, so as to turn on a Thin Film Transistor (TFT) at a pixel region whose gate electrode is connected to the gate line; and releasing residual charges on a pixel electrode to the data line through the TFT which has been turned on, the display control method further comprises, controlling, by the potential control unit, the discharging transistor to be turned on and controlling the display level end to write a second level into the gate line at a touch time period.

8. The display control method according to claim 7, wherein the predetermined discharging level is a ground level.

9. A display control method for use in the display device according to claim 1, comprising steps of:

determining, by the determination unit, that the display device is powered off abnormally, and outputting an abnormal power-off indication signal to the potential control unit and the data line control unit;

receiving, by the data line control unit, the abnormal power-off indication signal, and controlling a data switch so that the data voltage supplying unit writes a predetermined discharging level into a data line;

receiving, by the potential control unit, the abnormal power-off indication signal, and outputting a discharging control signal to a control end of the discharging unit, and controlling a potential at the display level end to be a first level;

receiving, by the discharging unit, the discharging control signal at the control end of the discharging unit, and controlling the display level end to write the first level into the gate line, so as to turn on a Thin Film Transistor (TFT) at a pixel region whose gate electrode is connected to the gate line; and releasing residual charges on a pixel electrode to the data line through the TFT which has been turned on, wherein the display level end of the display device is a display low-level end, and the display control method further comprises enabling the display low-level end to be separated from an electrostatic protection low-level end of the display device, so that the display low-level end is not connected to the electrostatic protection low-level end.

* * * * *